US007817007B2

(12) United States Patent
Lee et al.

(10) Patent No.: US 7,817,007 B2
(45) Date of Patent: Oct. 19, 2010

(54) LAMINATED INDUCTOR

(75) Inventors: Byoung Hwa Lee, Gyunggi-do (KR); Sung Kwon Wi, Seoul (KR); Hyeog Soo Shin, Busan (KR); Dong Seok Park, Seoul (KR); Sang Soo Park, Gyunggi-do (KR); Min Cheol Park, Gyunggi-do (KR)

(73) Assignee: Sumitomo Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/194,935

(22) Filed: Aug. 20, 2008

(65) Prior Publication Data

US 2009/0051474 A1 Feb. 26, 2009

(30) Foreign Application Priority Data

Aug. 20, 2007 (KR) ..... 10-2007-0083545

(51) Int. Cl.
*H01F 5/00* (2006.01)

(52) U.S. Cl. ..... 336/200

(58) Field of Classification Search ..... 336/65, 336/83, 192, 200, 232
See application file for complete search history.

(56) References Cited

U.S. PATENT DOCUMENTS

| | | | | |
|---|---|---|---|---|
| 4,904,967 | A * | 2/1990 | Morii et al. | 333/185 |
| 6,515,568 | B1 | 2/2003 | Maki et al. | |
| 2001/0017582 | A1 | 8/2001 | Sakata | |
| 2007/0152793 | A1 | 7/2007 | Kim et al. | |
| 2009/0184794 | A1 * | 7/2009 | Tsuzuki | 336/200 |

FOREIGN PATENT DOCUMENTS

| | | | |
|---|---|---|---|
| EP | 1 710 814 | A1 | 10/2006 |
| JP | 09186017 | A * | 7/1997 |
| JP | 2006-318946 | | 11/2006 |
| KR | 2001-0085376 | | 9/2001 |
| KR | 10-2007-0000419 | | 1/2007 |
| KR | 10-2007-0075148 | | 7/2007 |

* cited by examiner

*Primary Examiner*—Tuyen Nguyen
(74) *Attorney, Agent, or Firm*—McDermott Will & Emery LLP

(57) ABSTRACT

There is provided a laminated inductor including: a body where a plurality of magnetic layers are laminated; a coil part formed on the magnetic layers, the coil part including a plurality of conductor patterns and a plurality of conductive vias; first and second external electrodes formed on an outer surface of the body to connect to both ends of the coil part, respectively; and a non-magnetic conductor formed on at least one of the magnetic layers so as to relax magnetic saturation caused by direct current flowing through the coil part. The laminated inductor employs the non-magnetic conductor as a non-magnetic gap to be simplified in a manufacturing process and effectively improved in DC superposition characteristics.

17 Claims, 8 Drawing Sheets

LAMINATED INDUCTOR

CROSS-REFERENCE TO RELATED APPLICATIONS

This application claims the priority of Korean Patent Application No. 2007-83545 filed on Aug. 20, 2007, in the Korean Intellectual Property Office, the disclosure of which is incorporated herein by reference.

BACKGROUND OF THE INVENTION

1. Field of the Invention

The present invention relates to a laminated inductor, and more particularly, to a laminated inductor structured to improve direct current (DC) bias characteristics.

2. Description of the Related Art

Conventionally, a direct current/direct current (DC/DC) converter used as a major power source for a personal computer and mobile devices has mainly adopted a transformer or choke coil having a coil wound around a magnetic core. However, recently, with the demand for a smaller and thinner product, a laminated inductor, which is a chip part of a laminated structure, has been commercially viable.

A general laminated inductor has a structure such that a plurality of magnetic layers each having conductor patterns thereon are laminated. The conductor patterns are sequentially connected by a conductive via formed in each of the magnetic layers and overlapped in a laminated direction to thereby form a spiral-structured coil. Moreover, the coil has both ends drawn out to an outer surface of a laminated body to be connected to external terminals, respectively.

As described above, the laminated inductor has a coil surrounded by a magnetic body and thus experiences less magnetic flux leakage. Also, the laminated inductor can be beneficially reduced in size and thickness due to its laminated chip structure.

However, despite these advantages, the laminated inductor for use in a power circuit such as a DC/DC converter undergoes a sharp decrease in inductance, or degraded in DC bias characteristics owing to magnetic saturation of the magnetic body. Therefore, studies for preventing such a rapid decline in inductance have been conducted.

U.S. Pat. No. 6,515,568 and Japanese Patent Laid-Open Publication No. 2006-318946 disclose conventional methods for improving DC bias characteristics. By these methods, a magnetic substance with a low magnetic permeability or non-magnetic substance is inserted into a chip to delay magnetic saturation of a magnetic body.

According to the conventional technologies, layers where conductor patterns are formed are partially substituted by electrically insulating non-magnetic layers, or a portion of a corresponding layer is formed of an electrically insulating non-magnetic material.

However, these methods require more materials to be utilized due to selection of a heterogeneous non-magnetic material and entail a subsequent additional process cumbersomely. Notably, when a portion of the corresponding layer is substituted, a process of laminating sheets is considerably complicated.

Besides, conventionally, a heterogeneous material of non-magnetic layer is intercalated between the magnetic layers mainly constituting an inductor body. Therefore, the non-magnetic layer may be detached from other layers during firing due to differences in a shrinkage ratio.

SUMMARY OF THE INVENTION

An aspect of the present invention provides a laminated inductor which employs a non-magnetic gap of a novel structure in place of intercalating a non-magnetic layer, i.e., a heterogeneous material between magnetic layers of a body, thereby improving DC bias or superposition characteristics.

According to an aspect of the present invention, there is provided a laminated inductor including: a body where a plurality of magnetic layers are laminated; a coil part formed on the magnetic layers, the coil part including a plurality of conductor patterns and a plurality of conductive vias; first and second external electrodes formed on an outer surface of the body to connect to both ends of the coil part, respectively; and a non-magnetic conductor formed on at least one of the magnetic layers so as to relax magnetic saturation caused by direct current occurring in the coil part.

The non-magnetic conductor may be formed of a metal with low permeability. Particularly, the non-magnetic conductor may be formed of a material identical to the conductor patterns of the coil part.

The non-magnetic conductor and the conductor patterns may be formed of one of Ag and Cu, which are chiefly utilized for the conductor patterns of the coil part.

The non-magnetic conductor may be formed on another magnetic layer where the conductive patterns of the coil part are not formed. That is, the at least one magnetic layer may not be provided thereon with a corresponding one of the conductor patterns for the coil part. Here, the non-magnetic conductor may have an open area provided therein to be insulated from the conductive via formed in a corresponding one of the magnetic layers.

Alternatively, the non-magnetic conductor may be formed on a corresponding one of the magnetic layers where the conductive patterns of the coil part are formed. That is, the at least one magnetic layer may be provided thereon with a corresponding one of the conductor patterns for the coil part, and the non-magnetic conductor may be electrically insulated from the conductor patterns.

Furthermore, the non-magnetic conductor employed as a non-magnetic gap according to the present invention may be largely broken down into two types depending on connection or non-connection with the first and second external electrodes.

That is, the non-magnetic conductor may be configured as a floating type and a non-floating type. In the former, the non-magnetic conductor is not connected to the first and second external electrodes and in the latter, the non-magnetic conductor is connected to at least one of the first and second electrodes.

To be configured as a non-floating type, the non-magnetic conductor needs to satisfy conditions in which an electrical short does not occur. For example, the non-magnetic conductor may be extended to a portion of the outer surface of the body where one of the first and second external electrodes is formed.

The non-magnetic conductor may include at least two segments on the magnetic layer. Here, one of the at least two segments may be extended to a portion of the outer surface of the body where the first external electrode is disposed, and the other segment is extended to another portion of the outer surface of the body where the second external electrode is disposed. Also, the non-magnetic conductor divided into the plurality of areas prevents eddy current loss more effectively.

To improve DC bias characteristics more effectively, the non-magnetic conductor may be a plurality of non-magnetic conductors, and the plurality of non-magnetic conductors may be formed on the plurality of magnetic layers, respectively.

Here, the plurality of magnetic layers may include first and second magnetic layers, wherein the non-magnetic conductor formed on the first magnetic layer may include an area that is not overlapped with the non-magnetic conductor formed on the second magnetic layer, in a laminated direction. The non-magnetic conductor may be extended to a portion of the outer surface of the body where the first and second external electrodes are not formed, and a protective layer is formed on the portion of the outer surface of the body where the non-magnetic conductor is extended so as to prevent the non-magnetic conductor from being exposed.

The non-magnetic conductor may be spaced apart from a portion of the outer surface of the body where the first and second external electrodes are not formed. Alternatively, the non-magnetic conductor may be extended to a portion of the outer surface of the body where the external terminals are formed.

A protective layer may be formed on the portion of the outer surface of the body where the non-magnetic conductor is extended so as to prevent the non-magnetic conductor from being exposed.

Various arrangements and shapes of the non-magnetic conductor according to the present invention may be applied in combination. Also, the non-magnetic conductor as the non-magnetic gap and the conductor pattern for the coil part may be modified in shape, particularly area.

The plurality of conductor patterns may have overlapping areas with one another, respectively and at least one of the conductor patterns may have an extension area extended to an area other than a corresponding one of the overlapping areas.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1A:
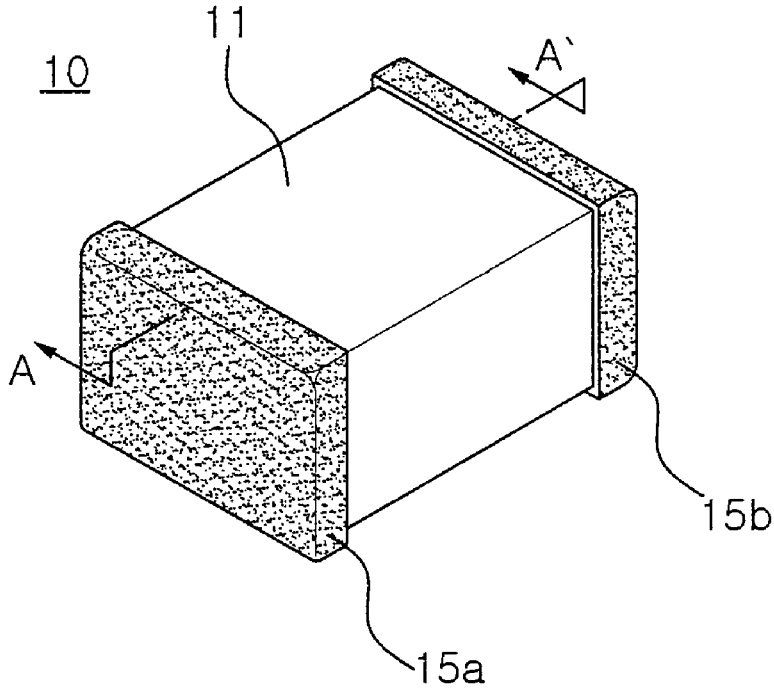
FIGS. 1A and 1B are an external perspective view and a side cross-sectional view illustrating a laminated inductor, respectively according to an exemplary embodiment of the invention.
Figure 1B:
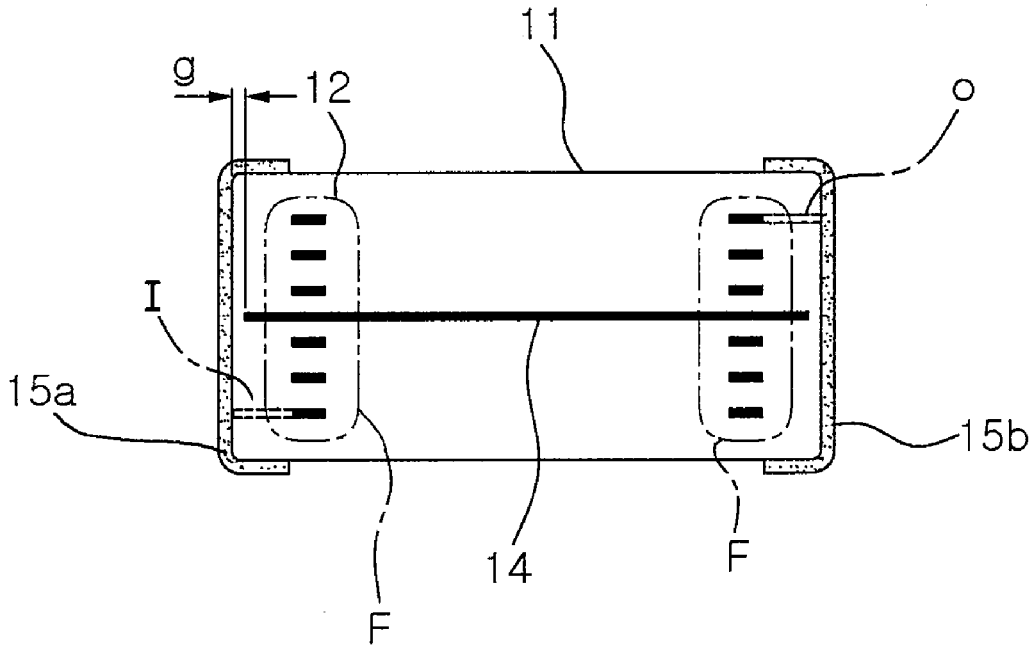
Figure 2:
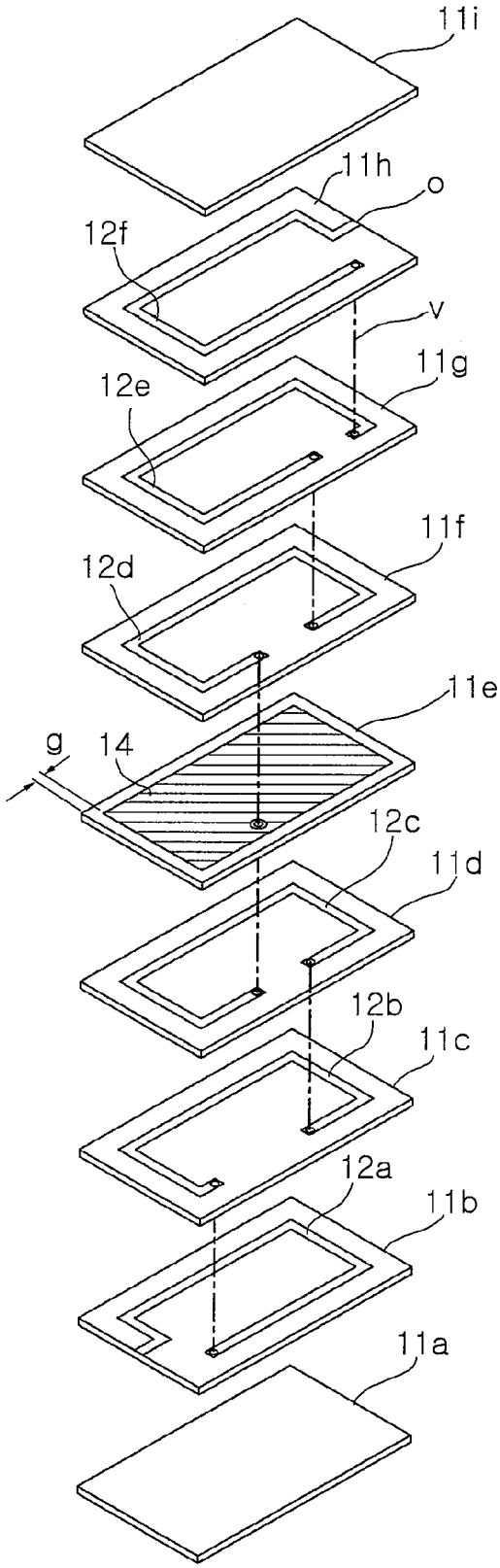
FIG. 2 is an exploded perspective view for explaining a laminated inductor structure shown in FIG. 1.

FIGS. 1A and 1B are an external perspective view and a side cross-sectional view illustrating a laminated inductor, respectively according to an exemplary embodiment of the invention. FIG. 2 is an exploded perspective view for explaining a laminated inductor structure shown in FIG. 1.

Referring to FIG. 1A, the laminated inductor 10 includes a body formed of magnetic layers, and first and second external electrodes 15*a* and 15*b* formed on opposing surfaces of the body 11.

As shown in FIG. 2, the body 11 of the laminated inductor has a plurality of magnetic layers 11*a* to 11*i* laminated therein. Some of the magnetic layers 11*a* to 11*i* function as cover layers 11*a* and 11*i* and the cover layers each may be formed of a plurality of layers.

In the present embodiment, the magnetic layers 11*b* to 11*d* and 11*f* to 11*h* excluding the portions 11*a*, 11*e* and 11*i*, e.g., cover layers are provided with conductor patterns 12*a* to 12*g* and conductive vias v, respectively. The conductor patterns 12*a* to 12*g* and the conductive vias v form a coil part (see reference numeral 12 of FIG. 1B) wound in overlapping portions. The coil part 12 has both ends I and O drawn out to connect to the first and second external electrodes 15*a* and 15*b*, respectively.

As shown in FIG. 1B, in the laminated inductor 10, a magnetic flux F is generated around the coil part when direct current (DC) is applied. This results in magnetic saturation of the magnetic body and dramatically reduces inductance of the laminated inductor 10.

To overcome this problem, in the present embodiment, a non-magnetic conductor 14 is additionally disposed on one lie of the magnetic layers. The non-magnetic conductor 14 is formed of a material having low permeability for acting as a non-magnetic gap, and electrical conductivity as well.

As shown in FIGS. 1B and 2, the non-magnetic conductor 14 is formed on a predetermined one 11*e* of the magnetic layers to have an area covering an inner portion and an outer portion of the overlapping area of the coil part 12. Here, the non-magnetic conductor 14 utilized as a non-magnetic gap in the present embodiment is electrically conductive. Thus, to prevent an undesired short from occurring, the non-magnetic conductor needs to be not electrically connected to the first and second external electrodes 15*a* and 15*b* and other conductor patterns 12*a* to 12*f*, respectively.

In the present embodiment, the non-magnetic conductor 14 is formed at a predetermined distance g from the respective surfaces of the body where the first and second external electrodes 15*a* and 15*b* are formed so as to be electrically insulated from the first and second external electrodes 15*a* and 15*b*. The non-magnetic conductor 14 may be formed on a predetermined one lie of the magnetic layers where the conductor patterns of the coil part are not formed.

Also, in a case where a corresponding one of the conductive vias v passes through the non-magnetic conductor 14 to connect the conductor patterns 12*c* and 12*d* adjacent to the non-magnetic conductor 14, the non-magnetic conductor 14 may have an open area to be electrically insulated from the conductive via v.

The non-magnetic conductor 14 of the present invention may be variously formed at a position which can relax magnetic saturation caused by the DC occurring in the coil part 12. Moreover, in the present embodiment, the non-magnetic conductor is illustrated to be formed on an additional magnetic layer. Alternatively, the non-magnetic conductor may be formed on the magnetic layer where the conductor patters are formed, as described later.

In the present embodiment, the non-magnetic conductor 14 employed as a non-magnetic gap is construed not as an element substituting the magnetic layers of the body 11 but an element formed by a process similar to that of forming the conductor patterns 12*a* to 12*f*, e.g., printing process using paste.

Therefore, the non-magnetic conductor 14 can be formed on the magnetic layer made of an identical material, thereby fundamentally free from detachment from other magnetic layers. Furthermore, the non-magnetic conductor 14 may be not formed by an additional process but a process similar to that of printing the conductor patterns 12*a* to 12*f*.

The non-magnetic conductor 14 may be formed of a material identical to the conductor patterns 12*a* to 12*f* of the coil part. Here, the non-magnetic conductor 14 is formed by a process identical to the process of printing the conductor patterns and can be formed on the magnetic layer made of the identical material. Accordingly, to form the non-magnetic conductor 14, a general process of manufacturing a laminated inductor can be employed without involving additional selection of materials or an additional process. As a representative example, the non-magnetic conductor 14 may be formed of Ag or Cu which is mainly utilized for the conductor patterns 12*a* to 12*f* constituting the coil part.

As described above, the non-magnetic conductor as the non-magnetic gap according to the present embodiment may be formed on a different position from the above embodiment, and may be variously configured. In designing this non-magnetic conductor with various modifications, DC bias characteristics can be relaxed more efficiently.

Particularly, the non-magnetic conductor of the present embodiment may be configured as a floating type or non-floating type depending on connection or non-connection with the external electrodes.

FIGS. 3 and 4 illustrate a non-magnetic conductor with a floating type similar to the one shown in FIG. 1 according to another exemplary embodiment of the invention and a laminated inductor employing the non-magnetic conductor, respectively.

Figure 3A:
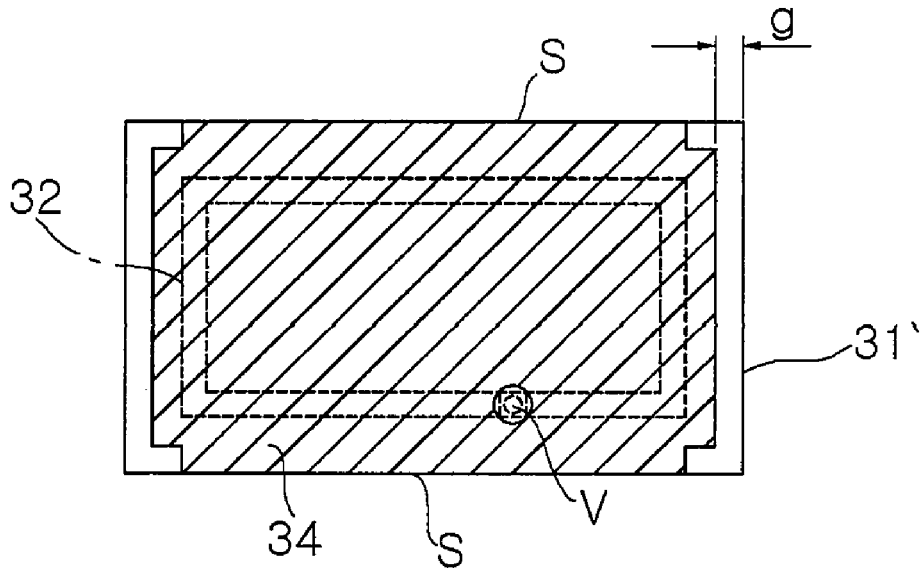
FIG. 3A is an upper plan view illustrating a non-magnetic conductor pattern applicable to a laminated inductor according to an exemplary embodiment of the invention and FIG. 3B is an external perspective view illustrating a laminated inductor employing the non-magnetic conductor pattern shown in FIG. 3A.
Figure 3B:
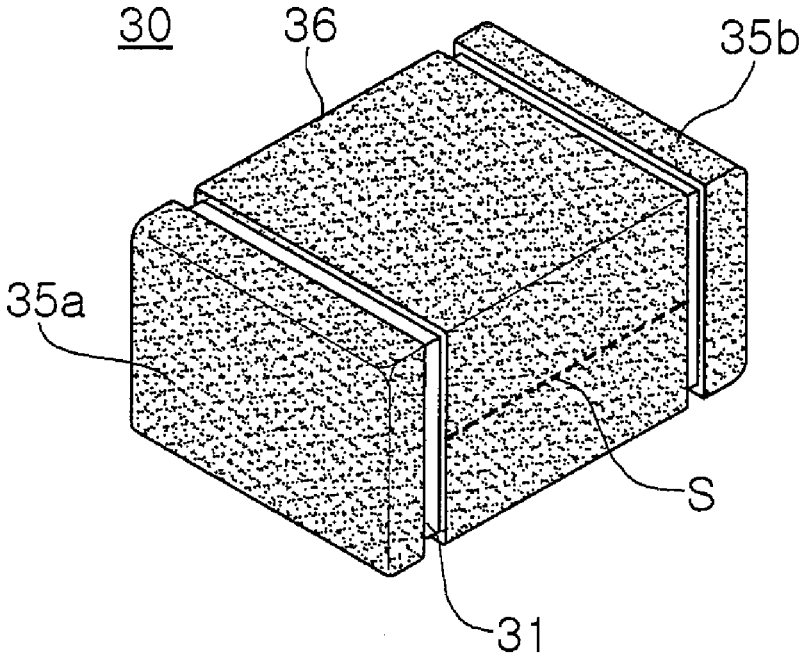

First, referring to FIG. 3A along with FIG. 3B, the non-magnetic conductor 34 acting as a non-magnetic gap is formed on one 31' of magnetic layers at a predetermined distance g from respective surfaces where first and second external electrodes 35*a* and 35*b* are formed to be electrically insulated from first and second external electrodes 35*a* and 35*b*.

The magnetic layer 31' where the non-magnetic conductor 34 is formed is another magnetic layer where conductor patterns of a coil part are not formed. The magnetic layer 31' is construed to be one of the layers constituting the laminated inductor 30. Also, similarly to the laminated inductor 10 shown in FIG. 1, the non-magnetic conductor 34 may have an open area provided therein to be electrically insulated from a corresponding one of conductive vias v for connecting the conductor patterns adjacent to the non-magnetic conductor 34.

However, the non-magnetic conductor 34 of the present embodiment is extended to edges S of the magnetic layer 31', i.e., surfaces where the external electrodes 35*a* and 35*b* are not formed. These extended portions are expected to more effectively block magnetic flux caused by the DC occurring in the coil part 32.

At this time, in a case where a material for the non-magnetic conductor 34 is a metal prone to oxidization, as shown in FIG. 3B, a protective layer may be additionally formed to prevent the non-magnetic conductor 34 extended to the edges S from being oxidized. This protective layer 36 may be formed of a material identical to the material for the external electrodes 35*a* and 35*b* to facilitate a process, that is, to be formed at the same time as the external electrodes 35*a* and 35*b* are formed.

Referring to FIG. 3A, the non-magnetic conductor 34 is illustrated to be formed on an additional magnetic layer where the conductor patterns are not formed. Alternatively, as shown in FIG. 4A, the non-magnetic conductor 44 may be formed on a magnetic body 41' where conductive patterns 42 are formed.

Figure 4A:
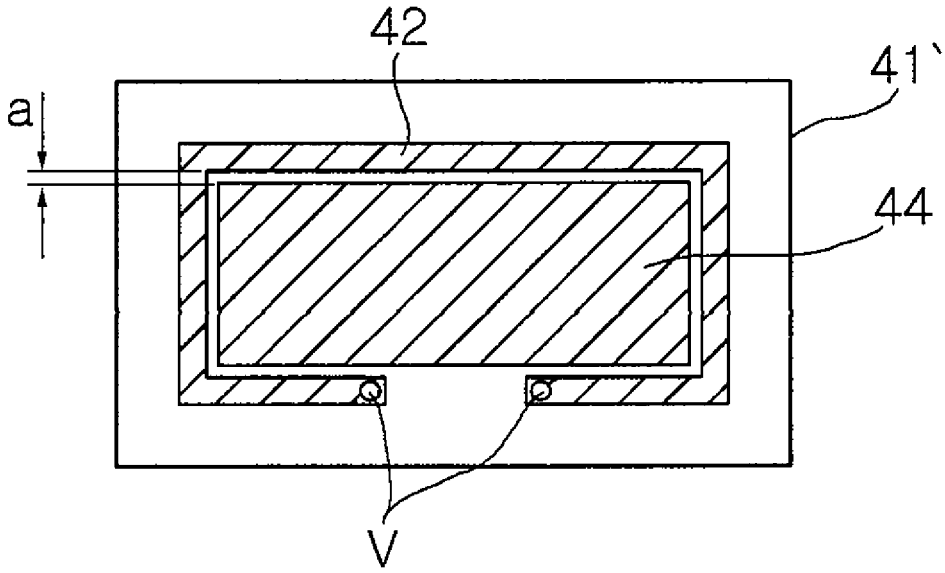
FIG. 4A is an upper plan view illustrating a non-magnetic conductor pattern (an example of a floating type) according to an exemplary embodiment of the invention and FIG. 4B is a side cross-sectional view illustrating a laminated inductor employing a non-magnetic conductor pattern shown in FIG. 4A.
Figure 4B:
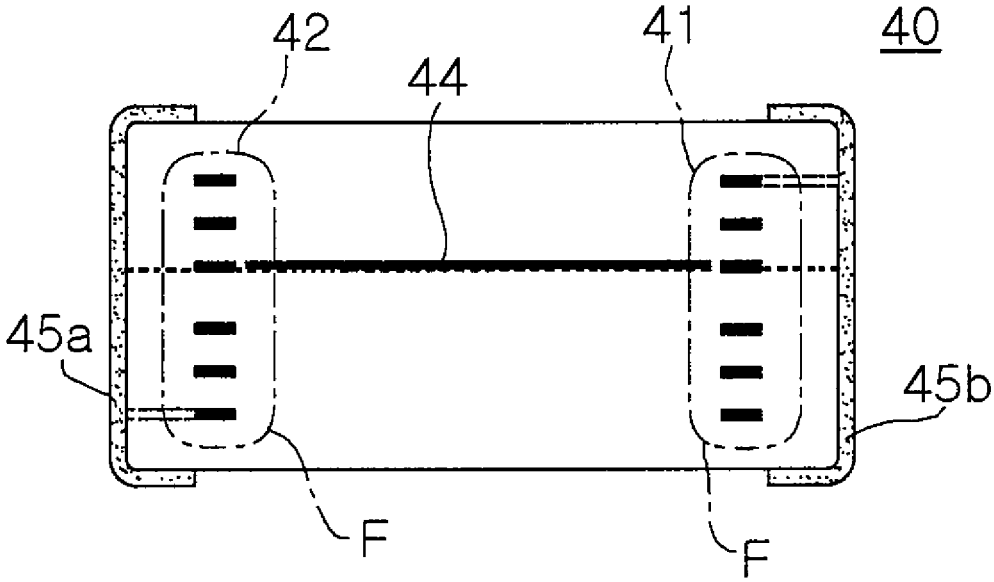

Referring to FIG. 4A, the non-magnetic conductor 44 is formed on one of the magnetic layers together with the conductor patterns 42'. The non-magnetic conductor 44 is formed at a predetermined distance from the conductor patterns 42' to prevent an undesired short with the conductor patterns 42' from occurring.

In the present embodiment, the non-magnetic conductor 44 is formed in an inner portion of the conductor pattern 42' or coil part 42. As demonstrated in a cross-sectional structure of the laminated inductor 40 of FIG. 4B, this effectively blocks magnetic flux caused by the DC in the inner portion of the coil part 42. Of course, in the present embodiment, an additional non-magnetic conductor may be formed on an outer portion of the coil part 42 not to be connected to the conductor pattern 42'.

Unlike the aforesaid embodiments, FIGS. 5 and 6 illustrate a non-magnetic conductor with a non-floating type and a laminated inductor employing the same, respectively.

Figure 5A:
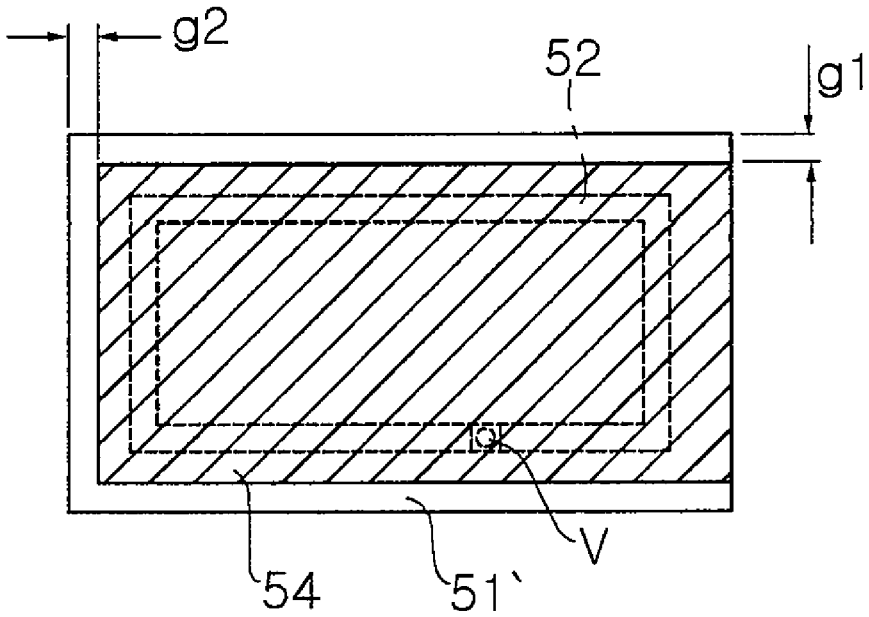
FIG. 5A is an upper plan view illustrating a non-magnetic conductor pattern (an example of a non-floating type) applicable to a laminated inductor according to an exemplary embodiment of the invention and FIG. 5B is a side cross-sectional view illustrating a laminated inductor employing the non-magnetic conductor pattern shown in FIG. 5A.
Figure 5B:
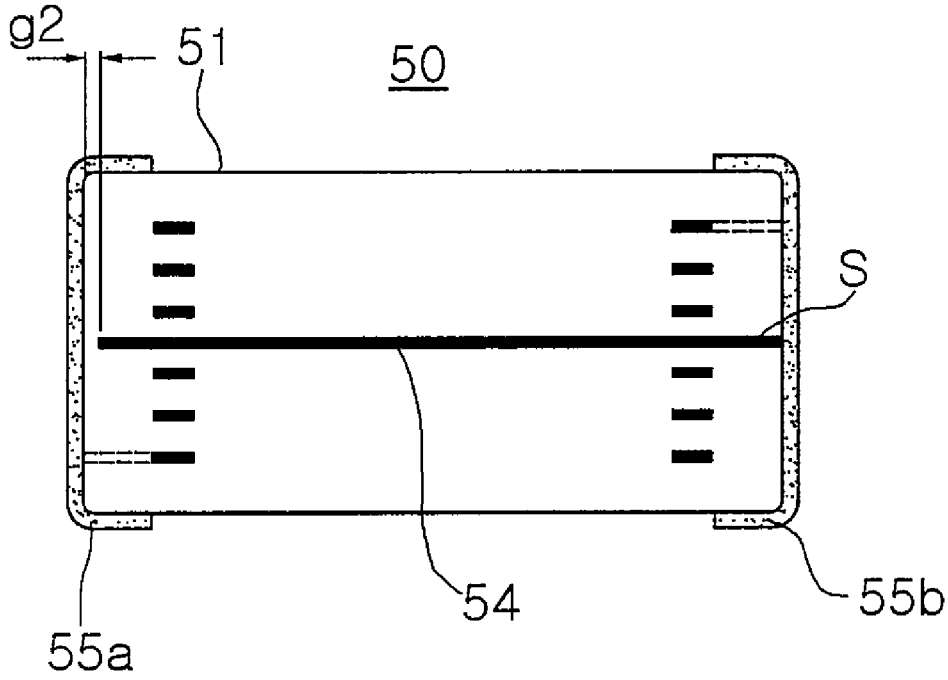

Referring to FIGS. 5A and 5B, the non-magnetic conductor 54 acting as a non-magnetic gap is formed on one 51' of magnetic layers. The non-magnetic conductor 54 may have an open area provided therein to be electrically insulated from a conductive via for connecting conductor patterns adjacent thereto together.

The non-magnetic conductor 54 has a first distance $g_1$ from both surfaces where external electrodes 54*a* and 54*b* are not formed and has a second distance $g_2$ from a surface where a first external electrode 55*a* is formed. However, in the present embodiment, the non-magnetic conductor 54 is extended to an edge S, i.e., a surface where the second external electrode 55*b* is formed. Here, the non-magnetic conductor 55 with electrical conductivity may be connected to the second external electrode 55*b* but is electrically insulated from the first external electrode 55*a* opposing the second external electrode 55*b*. Accordingly, this prevents a short from occurring.

As shown in FIG. 5B, the non-magnetic conductor 54 is extended to an edge S and thus more effectively blocks magnetic flux F in a coil part 52 adjacent to at least the second external electrode 55*b* than in the case of the laminated inductor 10 shown in FIG. 1.

In the previous embodiment, only one non-magnetic conductor is provided on one magnetic layer, but the present invention is not limited thereto. That is, the non-magnetic conductor having a plurality of segments may be formed on the one magnetic layer.

Figure 6A:
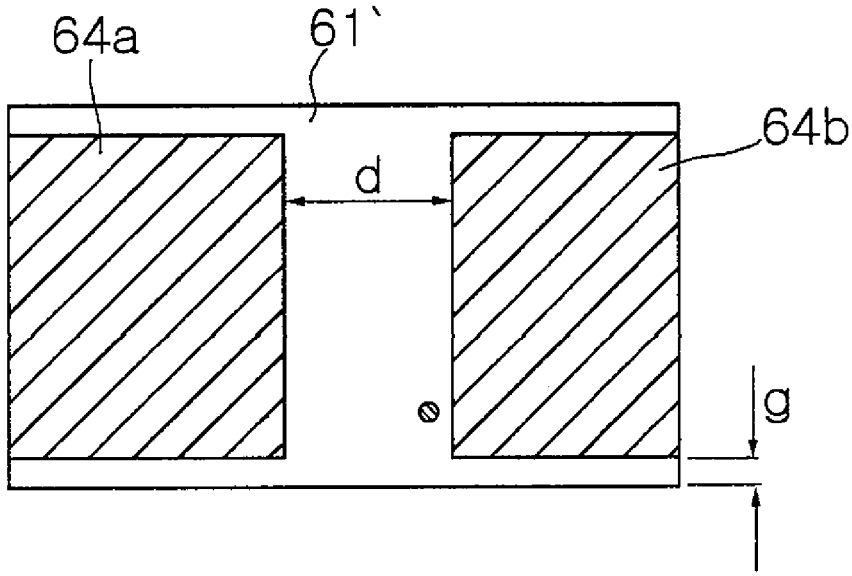
FIG. 6A is an upper plan view illustrating a non-magnetic conductor pattern (another example of a non-floating type) applicable to a laminated inductor according to an exemplary embodiment of the invention and FIG. 6B is a side cross-sectional view illustrating a laminated inductor employing the non-magnetic conductor pattern shown in FIG. 6A.

FIG. 6A illustrates two non-magnetic conductors 64*a* and 64*b* formed on a magnetic layer 61'.

As shown in FIG. 6A, the segmented non-magnetic conductors 64*a* and 64*b* may be formed on the one magnetic layer 61'. Here, the non-magnetic conductors 64*a* and 64*b* are formed at both edges to connect to first and second external electrodes 65*a* and 65*b*. The non-magnetic conductors 64*a* and 64*b*, even though connected to the first and second external electrodes 65*a* and 65*b*, are separated and electrically insulated from each other to be prevented from being shorted.

Figure 6B:
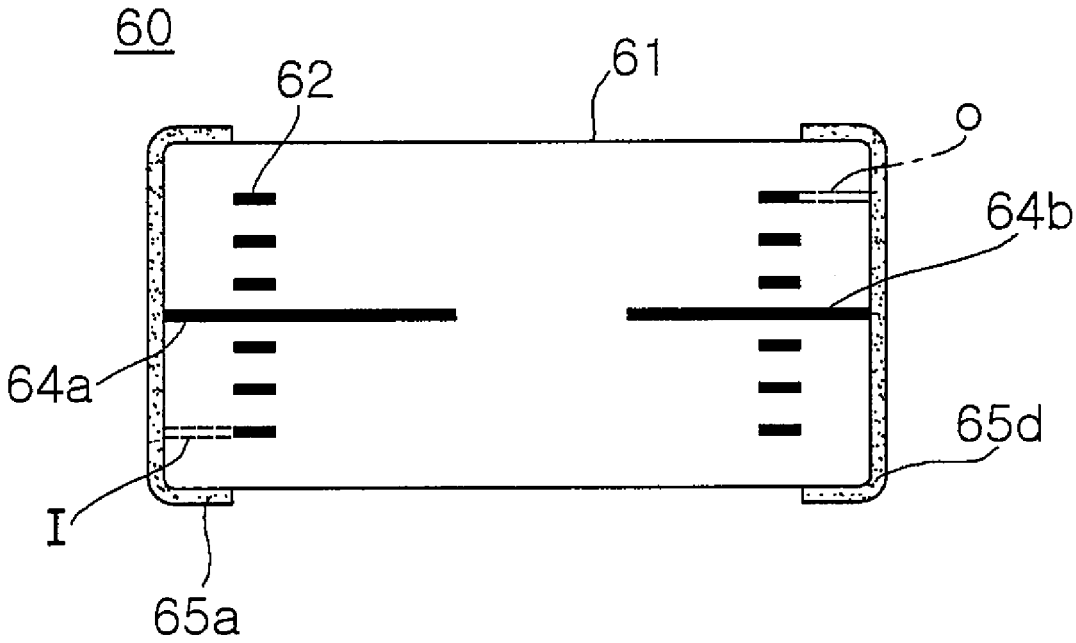

The non-magnetic conductors 64*a* and 64*b* of the present embodiment ensure magnetic flux to be further blocked at both edges. As shown in FIG. 6B, the non-magnetic conductors 64*a* and 64*b* configured as just described can be beneficially applied to a case where the magnetic flux needs to be blocked more efficiently in an outer portion than one closer to a central inner portion of the coil part 62. Also, in this structure, the two non-magnetic conductors 64*a* and 64*b* can be designed such that a conductive via passes through an isolated area between the segments, thereby potentially precluding a need for forming an additional open area therein.

As described above with reference to FIG. 4A, the non-magnetic layer with two segments may be formed on the magnetic layer where the conductor pattern is formed. That is, an additional non-magnetic conductor may be provided in the outer portion of the coil part 42 in addition to the non-magnetic conductor 44 formed in an inner portion of the coil part 42 as shown in FIG. 4A.

Also, in a similar manner to the embodiment of FIG. 6, the non-magnetic conductor may be divided into a plurality of smaller areas. This segmentation beneficially prevents eddy current loss with more efficiency.

The non-magnetic conductor structured variously according to the aforesaid embodiments may be configured alone. However, such various configurations of the non-magnetic conductor may be applied in combination to one layer within an allowable scope, or the non-magnetic conductors of at least two of the embodiments may be applied in combination to two different layers. This modification is construed to embrace the present invention as apparent to those skilled in the art.

Figure 7:
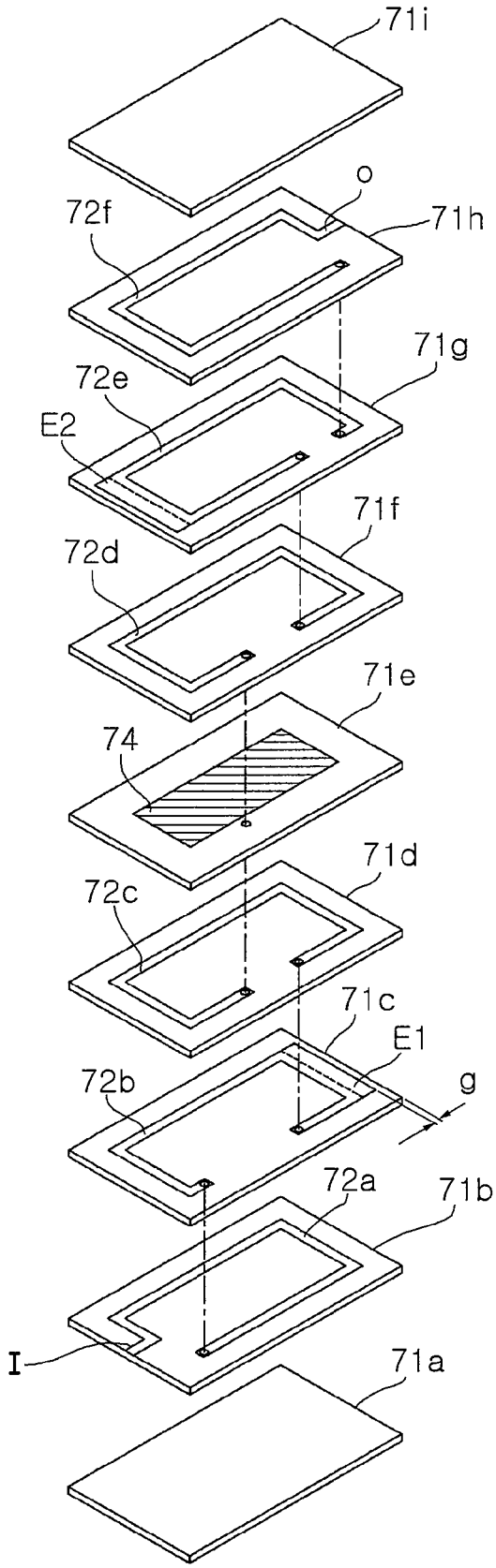
FIG. 7 is an exploded perspective view for explaining a laminated inductor structure according to another exemplary embodiment of the invention.
Figure 8:
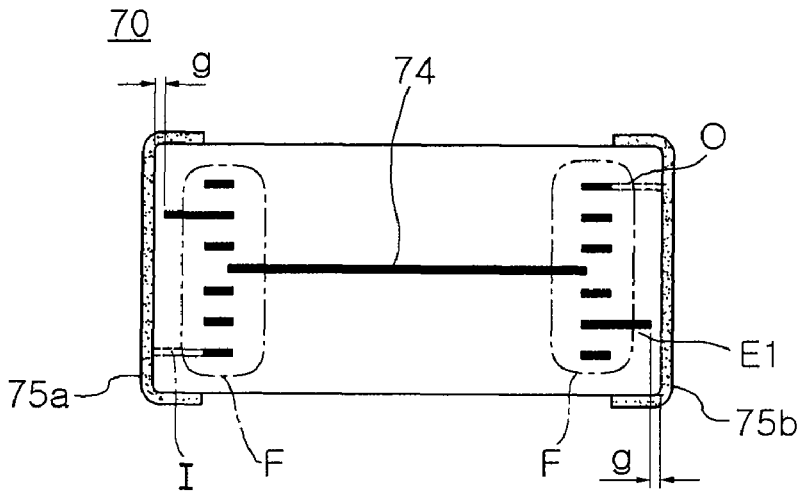
FIG. 8 is a cross-sectional view illustrating the laminated inductor shown in FIG. 7.

In addition to the combined applications of the above embodiments, as shown in FIGS. 7 and 8, the non-magnetic gap structure using the aforesaid non-magnetic conductor can ensure more effective DC bias characteristics by varying shape, particularly area of the conductor patterns of the coil part.

FIG. 7 is an exploded perspective view for explaining a laminated inductor structure according to another exemplary embodiment of the invention. FIG. 8 is a cross-sectional view illustrating the laminated inductor shown in FIG. 7.

Referring to FIG. 7 along with FIG. 8, the laminated inductor includes a body 71 having a plurality of magnetic layers 71*a* to 71*i* laminated therein. Here, some of the magnetic layers 71*a* and 71*i* serve as cover layers 71*a* and 71*i*. These cover layers each may be formed of a plurality of layers according to a thickness required.

In the present embodiment, conductor patterns 72*a* to 72*f* and conductive vias v are formed on the magnetic layers 71*b*-71*d* and 71*f*-71*h* excluding the portions 71*a*, 71*e*, and 71*i* of the magnetic layers such as the cover layers. The conductor patterns 72*a* to 72*f* are connected to one another by the conductive vias v to form a coil part wound in an overlapping position (see reference numeral 72 of FIG. 8). The coil part 82 has both ends I and O drawn out to connect to the first and second external electrodes 85*a* and 85*b*, respectively.

As shown in FIG. 7, the conductor patterns 72*a* to 72*f* are configured to have overlapping areas with one another, respectively in a similar manner to a general structure. The conductor patterns 72*b* and 72*e* located on predetermined magnetic layers 71*c* and 71*g* out of the conductor patterns 72*a* to 72*f* constituting the coil part 72 may be provided with extension areas E1 and E2 each extended to an area other than corresponding ones of the overlapping areas, respectively. Of course, as in the present embodiment, the extension areas E1 and E2, when provided on surfaces where external electrodes 75*a* and 75*b* are formed, are formed at a distance from the external electrodes 75*a* and 75*b*.

Moreover, in addition to the conductor patterns 72*b* and 72*b* having the extension areas E1 and E2*a*, a non-magnetic conductor 74 is formed on a predetermined one 71*e* of the magnetic layers to have an area covering an inner portion of the coil part 72. Here, the non-magnetic conductor 74 is illustrated to correspond to the inner portion of the coil part 72. Alternatively, the non-magnetic conductor 74 may be configured differently according to the aforesaid embodiments.

As shown in FIG. 8, in the laminated inductor 70 of the present embodiment, magnetic flux F generated around the coil part 72 due to DC is blocked by not only the non-magnetic conductor 74 but also the respective extension areas E1 and E2 of the conductor patterns 72*b* and 72*e*. Therefore, the DC value that causes magnetic saturation can be increased.

As described above, the laminated inductor of the present embodiment may be configured variously and modified into various combinations.

Hereinafter, the effects of better DC bias characteristics obtained by employing a laminated inductor of the present invention will be examined with reference to Inventive Example.

INVENTIVE EXAMPLE

In this Inventive Example, a laminated inductor having a similar structure as that shown in FIG. 1 was manufactured. Conductor patterns made of Ag paste were formed on six magnetic layers, respectively and a non-magnetic conductor (see FIG. 1B and 14 of FIG. 2) made of Ag metal was formed on another magnetic layer by a printing process identical to that for forming the conductor patterns. Thereafter, the magnetic layer having the non-magnetic conductor formed thereon was laminated in a middle portion of the magnetic body where the conductor patterns are formed, and fired. Afterwards, the magnetic body was cut into unit chips and then external electrodes were formed to produce the laminated inductor.

Comparative Example 1

In Comparative Example 1, a laminated inductor was manufactured by an identical process to that of Inventive Example to have an identical structure to the Inventive Example. The laminated inductor did not include a magnetic layer where a non-magnetic conductor was formed but only conductor patterns made of Ag.

Comparative Example 2

In Comparative Example 2, a laminated inductor was manufactured by an identical process to that of the Inventive Example to have an identical structure to the Inventive Example. The laminated inductor did not include a magnetic layer where a non-magnetic conductor was formed. But in a similar manner to a conventional art, an intermediate one of six magnetic layers was substituted by an electrically insulating non-magnetic layer. In Comparative Example 2, the non-magnetic layer employed as a non-magnetic gap served to constitute the body while having a size identical to other magnetic layers.

Figure 9:
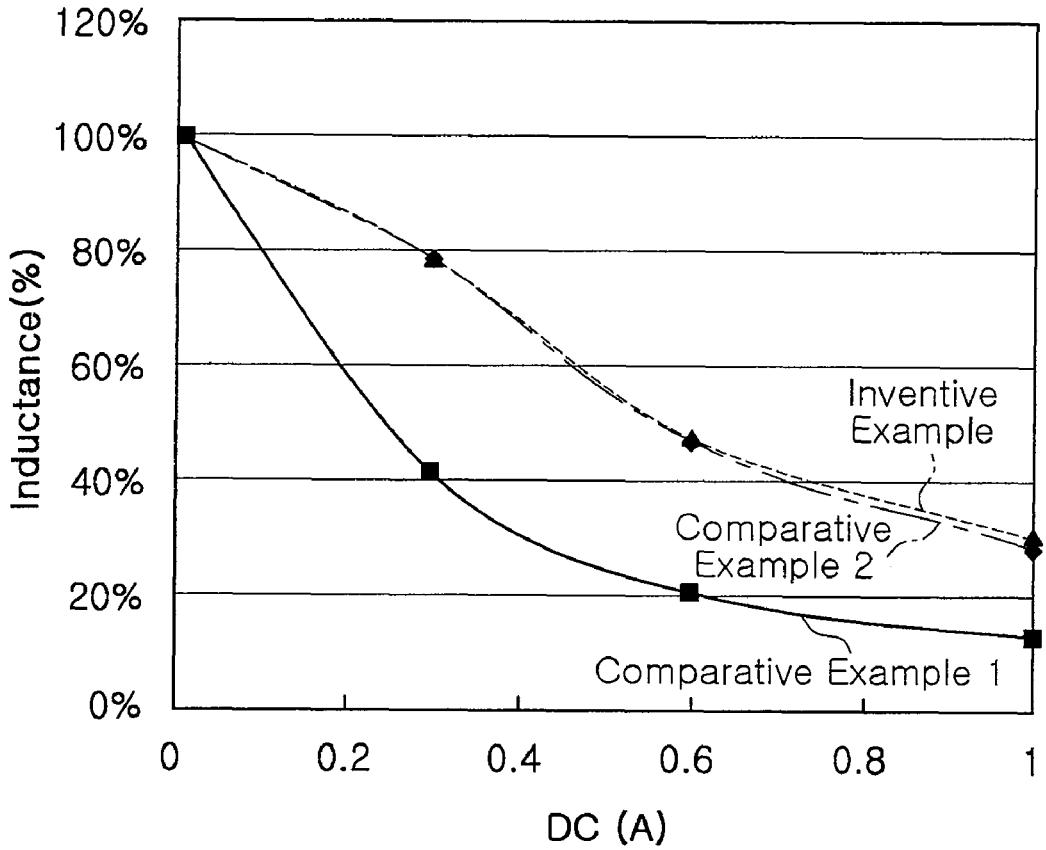
FIG. 9 is a graph illustrating inductance change with respect to direct current (DC) voltage in laminated inductors according to Inventive Example and Comparative Examples.

FIG. 9 is a graph illustrating inductance change with respect to DC voltage in laminated inductors according to Inventive Example and Comparative Examples.

Referring to FIG. 9, for Comparative Example 1 employing no magnetic gap, inductance is rapidly decreased with increase in DC. Meanwhile, for the Inventive Example, inductance is decreased at a similar level to Comparative Example 2. That is, the non-magnetic conductor of the present embodiment may have spatial limitations but assures substantially the same improvement in DC bias characteristics as the conventional non-magnetic gap of the electrically insulating non-magnetic body.

The effects of the Inventive Example can be obtained by employing a process similar to that for forming the conductor patterns, e.g, printing process using paste, without substituting the magnetic layer with the non-magnetic layer as shown in Comparative Example 2. The non-magnetic conductor formed of an identical material Ag as the conductor patterns according to the Inventive Example precludes a need for material selection or a subsequent additional process, thereby offering great advantages in the process.

Furthermore, the non-magnetic conductor of the Inventive Example can be formed on the magnetic layer of the same material and thus is fundamentally free from detachment from other magnetic layers.

As set forth above, according to exemplary embodiments of the invention, magnetic layers constituting a laminated inductor body as a main material are employed while utilizing, as a non-magnetic gap, a non-magnetic conductor which can be formed by only a simple printing process for conductor. This precludes a need for additional material selection and eliminates a subsequent complex process and allows for the laminated inductor superbly improved in DC bias characteristics.

While the present invention has been shown and described in connection with the exemplary embodiments, it will be apparent to those skilled in the art that modifications and variations can be made without departing from the spirit and scope of the invention as defined by the appended claims.

What is claimed is:

1. A laminated inductor comprising:

a body in which a plurality of magnetic layers are laminated;

a coil part formed on the magnetic layers, the coil part including a plurality of conductor patterns and a plurality of conductive vias;

first and second external electrodes formed on an outer surface of the body to connect to both ends of the coil part, respectively; and a non-magnetic conductor formed on at least one of the magnetic layers so as to relax magnetic saturation caused by direct current flowing through the coil part, wherein the non-magnetic conductor has an open area provided therein to be insulated from the conductive via formed in a corresponding one of the magnetic layers.

2. The laminated inductor of claim 1, wherein the non-magnetic conductor is formed of a metal.

3. The laminated inductor of claim 1, wherein the non-magnetic conductor is formed of a material identical to the conductor patterns of the coil part.

4. The laminated inductor of claim 3, wherein the non-magnetic conductor and the conductor patterns are formed of one of Ag and Cu.

5. The laminated inductor of claim 1, wherein the at least one magnetic layer does not have conductor patterns for the coil part formed thereon.

6. The laminated inductor of claim 1, wherein the at least one magnetic layer is provided thereon with a corresponding one of the conductor patterns for the coil part, and the non-magnetic conductor is electrically insulated from the conductor patterns.

7. The laminated inductor of claim 6, wherein the non-magnetic conductor is spaced apart from a portion of the outer surface of the body where the first and second external electrodes are not formed.

8. The laminated inductor of claim 6, wherein the non-magnetic conductor is extended to a portion of the outer surface of the body where the first and second external electrodes are not formed, and a protective layer is formed on the portion of the outer surface of the body where the non-magnetic conductor is extended so as to prevent the non-magnetic conductor from being exposed.

9. The laminated inductor of claim 6, wherein the non-magnetic conductor is spaced apart from the outer surface of the body where the first and second external electrodes are formed so as to be electrically insulated from the first and second external electrodes.

10. The laminated inductor of claim 6, wherein the non-magnetic conductor is extended to a portion of the outer surface of the body where one of the first and second external electrodes is formed.

11. The laminated inductor of claim 6, wherein the non-magnetic conductor comprises at least two segments on the magnetic layer.

12. The laminated inductor of claim 11, wherein one of the at least two segments is extended to a portion of the outer surface of the body where the first external electrode is disposed, and the other segment is extended to another portion of the outer surface of the body where the second external electrode is disposed.

13. The laminated inductor of claim 6, wherein the non-magnetic conductor comprises a plurality of non-magnetic conductors, wherein the plurality of non-magnetic conductors are formed on the plurality of magnetic layers, respectively.

14. The laminated inductor of claim 13, wherein the plurality of magnetic layers comprise first and second magnetic layers, wherein the non-magnetic conductor formed on the first magnetic layer comprises an area that is not overlapped with the non-magnetic conductor formed on the second magnetic layer, in a laminated direction.

15. The laminated inductor of claim 14, wherein the non-magnetic conductor formed on the first magnetic layer comprises an inner portion of the coil part, and the non-magnetic conductor formed on the second magnetic layer comprises an outer portion of the coil part.

16. The laminated inductor of claim 6, wherein the plurality of conductor patterns have overlapping areas with one another, respectively, and at least one of the conductor patterns comprises an extension area extended to an area other than a corresponding one of the overlapping areas.

17. A laminated inductor comprising:

a body in which a plurality of magnetic layers are laminated;

a coil part formed on the magnetic layers, the coil part including a plurality of conductor patterns and a plurality of conductive vias;

first and second external electrodes formed on an outer surface of the body to connect toe both ends of the coil part, respectively; and a non-magnetic conductor formed on at least one of the magnetic layers so as to relax magnetic saturation caused by direct current flowing through the coil part, wherein the non-magnetic conductor is formed of material identical to the conductor patterns of the coil part and electrically insulated from the conductor patterns.

* * * * *

UNITED STATES PATENT AND TRADEMARK OFFICE

CERTIFICATE OF CORRECTION

PATENT NO. : 7,817,007 B2
APPLICATION NO. : 12/194935
DATED : October 19, 2010
INVENTOR(S) : Byoung Hwa Lee et al.

It is certified that error appears in the above-identified patent and that said Letters Patent is hereby corrected as shown below:

On the Title Page of the Patent, in Item "(73) Assignee", please delete "Sumitomo Electro-Mechanics Co., Ltd." and add -- Samsung Electro-Mechanics Co., Ltd. --

Signed and Sealed this

Thirtieth Day of November, 2010

David J. Kappos

David J. Kappos
*Director of the United States Patent and Trademark Office*